US006325522B1

(12) United States Patent
Walian

(10) Patent No.: US 6,325,522 B1
(45) Date of Patent: Dec. 4, 2001

(54) HAND HELD DEVICE PROVIDING EFFECTIVE SITE ILLUMINATION

(76) Inventor: Harald Walian, 131 Kittywake Dr., Newport News, VA (US) 23608

( * ) Notice: Subject to any disclaimer, the term of this patent is extended or adjusted under 35 U.S.C. 154(b) by 0 days.

(21) Appl. No.: 09/399,084

(22) Filed: Sep. 20, 1999

(51) Int. Cl.[7] ..... B25B 23/18

(52) U.S. Cl. ..... 362/119; 362/120; 362/205; 362/109; 362/203; 362/206; 362/118; 200/60

(58) Field of Search ..... 362/119, 120, 362/205, 109, 203, 206, 118; 200/60

(56) References Cited

U.S. PATENT DOCUMENTS

| | | | | |
|---|---|---|---|---|
| 2,344,370 | | 3/1944 | Shapiro | 240/6.46 |
| 2,378,544 | | 6/1945 | Fosse | 66/177 |
| 4,107,765 | | 8/1978 | Singleton | 362/120 |
| 4,283,757 | | 8/1981 | Nalbandian | 362/120 |
| 4,656,565 | * | 4/1987 | Maglica | 362/187 |
| 5,161,095 | * | 11/1992 | Gammache | 362/197 |
| 5,826,969 | * | 10/1998 | Nevin | 362/120 |
| 5,980,077 | * | 11/1999 | Shiao | 362/578 |
| 6,022,121 | * | 2/2000 | Lin | 362/120 |
| 6,030,092 | * | 2/2000 | McCalla et al. | 362/120 |
| 6,033,082 | * | 4/2000 | Lin | 362/120 |
| 6,050,698 | * | 4/2000 | Lee | 362/120 |
| 6,089,729 | * | 7/2000 | Chang | 362/120 |
| 6,135,608 | * | 10/2000 | Lin | 362/119 |
| 6,213,621 | * | 4/2001 | Chien | 362/119 |
| 6,224,229 | * | 5/2001 | Lin | 62/119 |

FOREIGN PATENT DOCUMENTS

| | | | |
|---|---|---|---|
| 103428 | 1/1916 | (AT) | 362/120 |

* cited by examiner

*Primary Examiner*—Stephen Husar
*Assistant Examiner*—Anabel Ton
(74) *Attorney, Agent, or Firm*—George F. Helfrich

(57) ABSTRACT

A hand held device providing effective illumination of a site being worked on has a metal tube serving as a handle, at one end of which a switch is threaded therein, and at the other end of which a window is secured. Located within the handle are a battery, which communicates with the switch by means of a spring, and a light bulb, which faces the window. Interchangeable implements, including tools and instruments, are individually releasably secured within an orifice in the window. The switch operates simply, facilely, and positively, with no parts which will wear out.

10 Claims, 3 Drawing Sheets

HAND HELD DEVICE PROVIDING EFFECTIVE SITE ILLUMINATION

BACKGROUND OF THE INVENTION

1. Field of the Invention

The present invention relates generally to hand tools and hand instruments. It relates in particular to hand held tools and hand held instruments which provide illumination of the site upon which the tool or instrument operates to bring about a desired effect.

2. Description of the Related Art

Hand held tools (e.g., implements used in carpentry, metal working, plumbing, and electricity) and hand held instruments (e.g., implements used in medicine, surgery, dentistry, drawing, painting, sculpting, crocheting, and knitting) have been known and employed for many, many years. However, in recent times attempts have been made to provide certain of these tools and instruments with an internal source of illumination, so that the area being worked on by the tool or instrument can be lighted without the employment of an outside illuminating source. For example, U.S. Pat. Nos. 2,378,544 and 2,344,370 disclose hand held knitting needles which provide some illumination of the workpiece. However, in both cases illumination is provided through the knitting needle itself. This does not afford enough light, and the light which is afforded is a small spot located at the exact point of contact with the workpiece. Moreover, the Lucite needles and phosphorescent tips of these references are brittle, scratch easily, and therefore have a limited useful life. Furthermore, one of these devices requires house current and has no effective on-off switch. As additional examples, U.S. Pat. Nos. 4,107,765 and 4,283,757 disclose hand tools such as screwdrivers which also provide for some illumination of the workpiece. However, these devices are also found wanting, because: they provide a spotty, rather than a concentric, evenly-illuminated working site; they do not disclose an on-off switch which operates simply, facilely, and positively, having no working parts to wear out; and they do not comprehend the interchangeability of various types of working implements.

SUMMARY OF THE INVENTION

It is accordingly a primary object of the present invention to provide what is not found in the art: i.e., a hand held device which provides effective illumination of a site being worked on and is versatile in including interchangeable working implements such as tools and instruments of various sizes. It is another object of the present invention to provide a hand held device which, in addition to the above advantages, includes an illumination switch which operates simply, facilely, and positively, and has no parts which will wear out. It is yet another object of the present invention to provide a hand held device having all of the above advantages and, in addition, the capability of illuminating the site being worked on concentrically and evenly, rather than spottily and unequally.

These objects and their attending benefits are achieved by the provision of a hand held device according to the present invention, which includes an elongated metal tube serving as a handle. The handle has a proximal end, which is threaded to receive and house a switch, and a distal end, which is adapted to secure a substantially transparent window. A battery is positioned within the handle, as is a light bulb. The light bulb includes a bulb, as well as a shoulder contact and a base contact for the bulb. The light bulb is positioned within the handle so that the bulb faces the window, the shoulder contact is in electrical contact with the handle, and the base contact is in electrical contact with the battery. Electrical contact between the handle and the shoulder contact of the light bulb is effected by means of indentations formed in the tubular wall of the handle, upon which indentations the shoulder contact of the light bulb is pressed. The substantially transparent window, which is secured in the distal end of the handle has an orifice therein which is adapted to releasably secure an interchangeable implement therein. This window is advantageously fabricated from a polycarbonate sheet or block, and the orifice therein is advantageously positioned in the approximate center of the polycarbonate sheet or block. The interchangeable working implements which are individually releasably secured in the orifice of the window are selected from yarn working devices such as crochet needles and knitting needles; marking tools, such as pens, pencils, and paint brushes; surgical instruments, such as needles, scalpels, probes and cauteries; dental instruments such as dental picks; and workmen's tools such as screwdrivers, files, and picks. The switch, which is housed in the proximal end of the handle, includes a knob having an outer end and an elongated inner end.

As is understood by the skilled artisan in view of the above, the device of the present invention is significant for a number of reasons, which include:

Light is directed onto the workpiece concentrically, rather than on a single spot or multiple spots. As a result, more of the workpiece is plainly visible by the worker employing the device. Moreover, the workpiece is illuminated with the same intensity, no matter how the device is turned. As a result, the device of the present invention is very efficient and efficacious in its operation.

Actual working implements are interchangeable, the handle of the device of the present invention being adapted to receive different sizes and types of implements, resulting in a versatility not heretofore comprehended.

Since the source of light herein is not the actual working implement itself, working implements according to the present invention can be made of very durable materials, since such are not required to transmit light.

Whereas devices of the related art require multiple light bulbs and multiple batteries to provide adequate illumination, the device of the present invention can function well with a single light bulb and a single battery, both of which are located within the handle.

The on-off switch of the device of the present invention is simple and easy for anyone to operate; its action is positive and sure; and there are no parts therein which will wear out.

This combination of characteristics is nowhere suggested in the related art.

BRIEF DESCRIPTION OF THE DRAWINGS

For a more complete understanding of the present invention, including its objects and attending benefits, reference should be made to the Detailed Description of the Invention, which is set forth below. This Detailed Description should be read together with the accompanying Drawings, wherein.

DETAILED DESCRIPTION OF THE INVENTION

Figure 1:
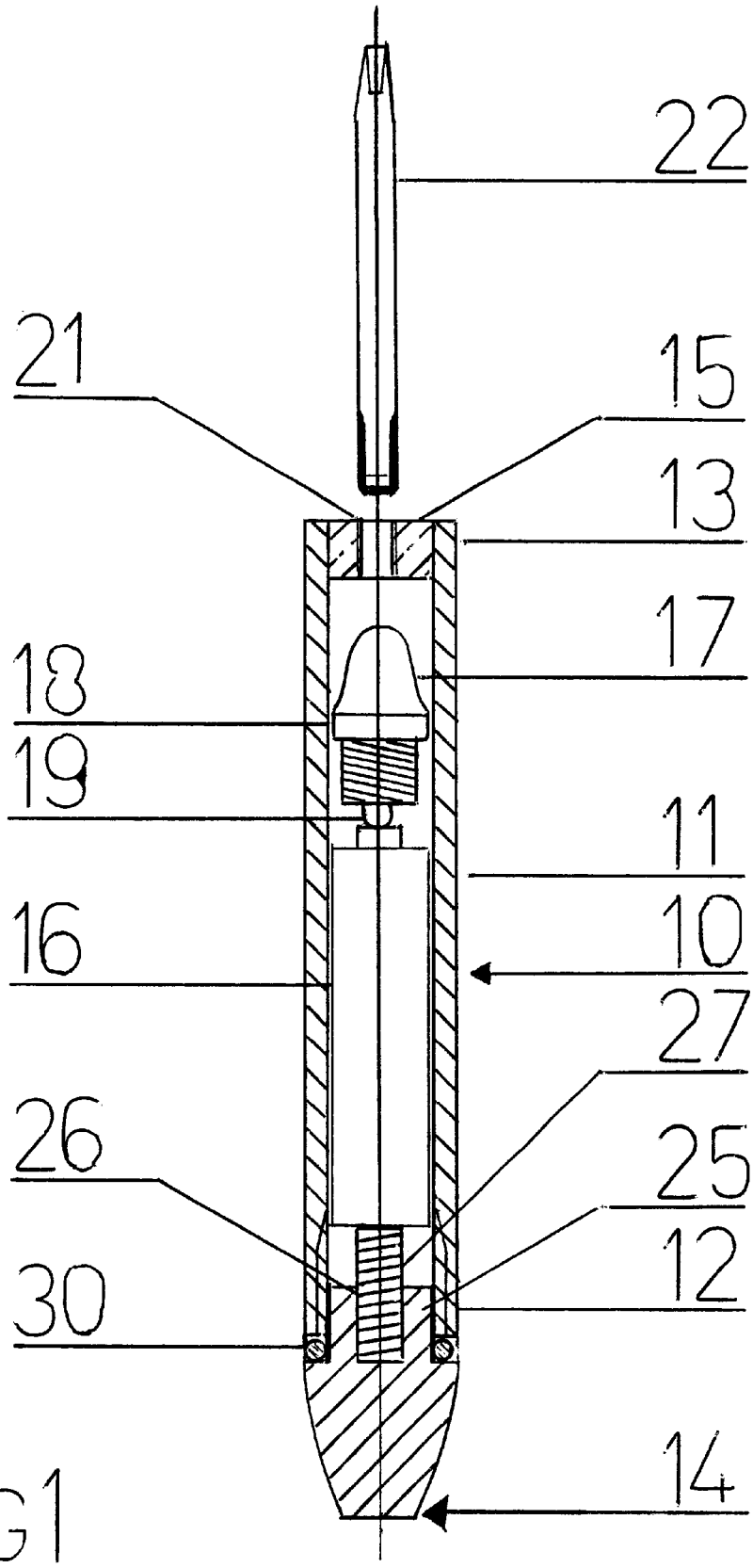
FIG. 1 is a schematic showing a preferred embodiment of a device according to the present invention.
Figure 2:
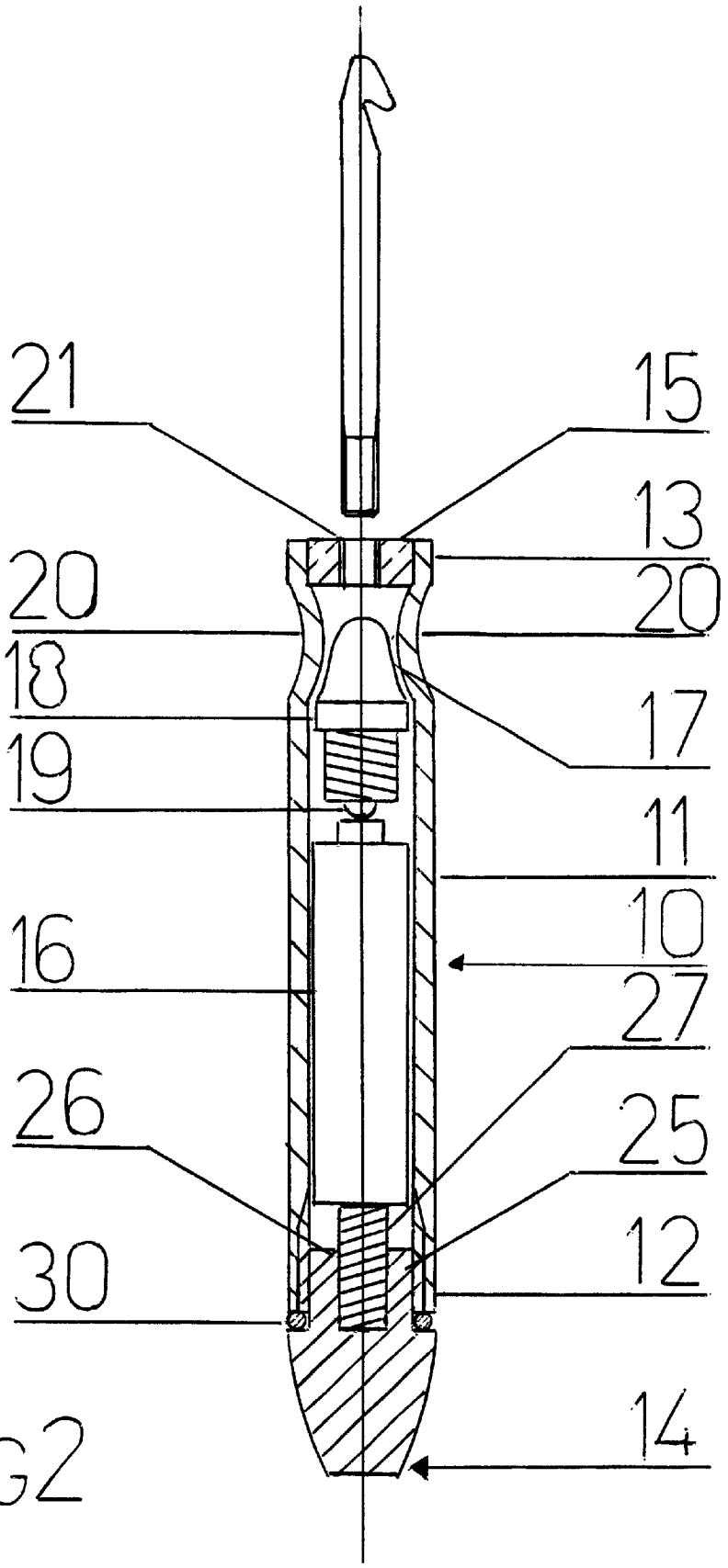
FIG. 2 is a schematic showing the embodiment of FIG. 1 which has been rotated 90° about its longitudinal axis.

Referring now to the Drawings, FIGS. 1 and 2 show a preferred embodiment of a device 10 according to the present invention. Device 10 includes a handle 11, which is advantageously an elongated metal tube. Although any metal can be used, aluminum is preferred. Handle 11 has a proximal end 12 and a distal end 13, proximal end 12 being threaded to receive and house switch 14, and distal end 13 being adapted to secure window 15 therein. Window 15, which is substantially transparent, is fabricated from a polymeric material such as a polycarbonate sheet or block. Lexan polycarbonate, which is available commercially, is advantageously employed. Located within handle 11 is a source of electric current, such as battery 16 as shown. Although the size of the battery employed is dependent upon the particularly desired application of the device of the present invention, standard size AAA has been found useful for many applications. Also located within the handle is a light bulb, which includes bulb 17, shoulder contact 18 and base contact 19. The light bulb may be an ordinary light bulb or one of the high intensity halogen varieties. The light bulb is positioned within handle 11 so that bulb 17 faces window 15, base contact 19 is in electrical contact with battery 16, and shoulder contact 18 is in electrical contact with handle 11. Such electrical contact between shoulder contact 18 and handle 11 is advantageously effected by means of indentations 20 which are formed in the wall of handle 11, as is shown in FIG. 2. Window 15 has orifice 21 therein for the purpose of releasably securing an interchangeable implement 22 therein. It has been found especially advantageous if orifice 21 is positioned in the approximate center of window 15, as shown in FIGS. 1 and 2. Although any standard means may be employed to releasably secure interchangeable implement 22 to window 15, a helicoil (not shown) is advantageously utilized to releasably lock interchangeable implement 22 in place. Interchangeable implement 22 is shown in FIGS. 1 and 2 to be a crochet needle. However, interchangeable implement 22 may be one of many tools and instruments including, but not limited to: crochet needles and knitting needles; screwdrivers, files, and picks; pens, pencils, and paint brushes; surgical instruments such as needles, scalpels, probes, and cauteries; and dental instruments of various kinds.

Figure 3:
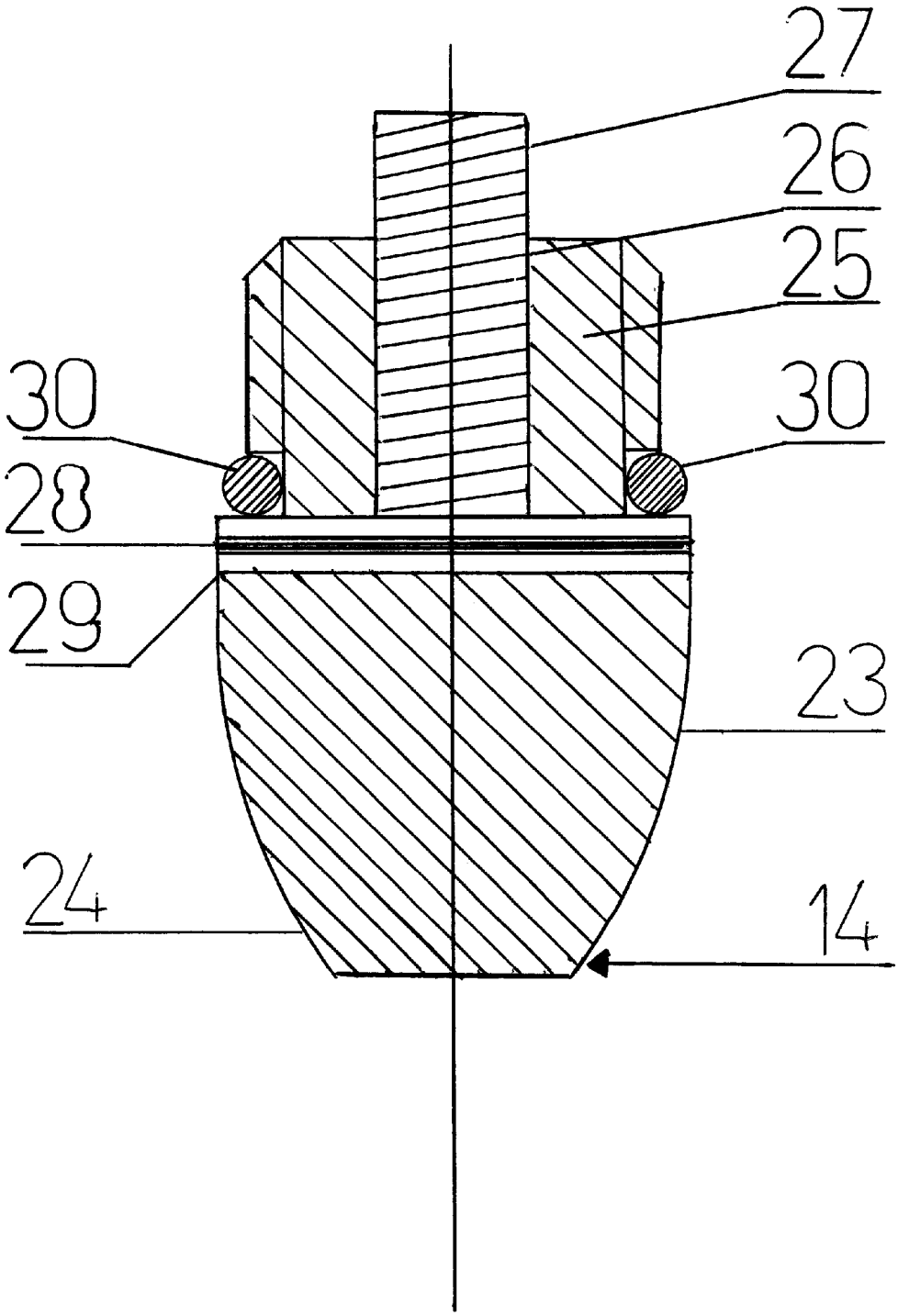
FIG. 3 is a schematic showing detail of the switch mechanism which is pictured in both FIGS. 1 and 2.

Switch 14, which is shown in more detail in FIG. 3, includes knob 23 having an outer end 24 and an elongated inner end 25, the inner end 25 having threads thereon for mating with proximal end 12 of handle 11. Knob 23 is advantageously formed from any of a large number of plastic materials available commercially. Inner end 25 of knob 23 has an aperture 26 therein for the purpose of holding and positioning metallic spring 27 therein so that spring 27 makes electrical contact with battery 16 (see FIGS. 1 and 2) when knob 23 has been threaded into proximal end 12 of handle 11. Knob 23 also has a transverse conducting pin 28 therein, which is located in channel 29 in knob 23, channel 29 being positioned perpendicularly to longitudinally directed aperture 26. Conducting pin 28 serves to hold spring 27 in place in longitudinally directed aperture 26. Metal ring 30 is positioned to encircle inner end 25 of knob 23 so that metal ring 30 is in electrical contact with conducting pin 28, but that metal ring 30 will make electrical contact with handle 11 at proximal end 12 thereof only when outer end 24 of knob 23 is turned to advance knob 23 into handle 11. A simple, easy, and positive on-off illumination switch 14 is the result. The metallic spring 27, the metal ring 30, and the conducting pin 28 are formed from any of a wide variety of metals and metal alloys available commercially, stainless steel being advantageously employed.

I claim:

1. A hand held device which provides effective illumination of a site being worked on, the device comprising: an elongated metal tube serving as a handle, the handle having a proximal end and a distal end, the proximal end being threaded to receive and house a switch, as recited hereinafter, and the distal end being adapted to secure a substantially transparent window, as recited hereinafter, therein; a battery located within the handle; a light bulb comprising a bulb, a shoulder contact, and a base contact, the light bulb located within the handle and positioned therein so that the bulb faces the window, the shoulder contact is in electrical contact with the handle, and the base contact is in electrical contact with the battery; a substantially transparent window as referred to above, which is secured in the distal end of the handle, the window having an orifice therein adapted for releasably securing an interchangeable implement therein, the interchangeable implement being a member selected from the group consisting of tools and instruments; and a switch as referred to above, which is housed in the proximal end of the handle, the switch comprising a knob having an outer end and an elongated inner end, the inner end having threads thereon for mating with the threaded proximal end of the handle, the inner end additionally having a longitudinally-directed aperture therein for holding and positioning a metallic spring therein so that the spring makes contact with the battery when the knob is threaded into the proximal end of the handle, the knob additionally having a transverse conducting pin therein which is located in a channel in the knob which is positioned perpendicularly to the longitudinally-directed aperture, the conducting pin serving to secure the spring in its place in the longitudinally-directed aperture; and a metal ring positioned to encircle the inner end of the knob at a location thereon so that it is in electrical contact with the transverse conducting pin, and so that it will make electrical contact with the handle only when the outer end of the knob is turned to advance the knob into the handle.

2. The hand held device of claim 1, wherein the implement is a member selected from the group consisting of crochet needles and knitting needles.

3. The hand held device of claim 1, wherein the implement is a marking tool selected from the group consisting of pens, pencils, and paint brushes.

4. The hand held device of claim 1, wherein the implement is a surgical instrument.

5. The hand held device of claim 4, wherein the surgical instrument is a member selected from the group consisting of needles, scalpels, probes, and cauteries.

6. The hand held device of claim 1, wherein the implement is a dental instrument.

7. The hand held device of claim 1, wherein the implement is a tool selected from the group consisting of screwdrivers, files, and picks.

8. The hand held device of claim 1, wherein the shoulder contact of the light bulb is pressed against indentations formed in the handle, thereby producing electrical contact between the light bulb and the handle.

9. The hand held device of claim 1, wherein the substantially transparent window is a polycarbonate sheet or block.

10. The hand held device of claim 9, wherein the orifice is positioned in the approximate center of the polycarbonate sheet or block.

* * * * *